US005211216A

United States Patent [19]

Drury et al.

[11] Patent Number: 5,211,216

[45] Date of Patent: May 18, 1993

[54] CASTING PROCESS

[75] Inventors: Paul E. Drury, Henderson, Ky.; James M. Evans, Evansvile, Ind.; Stephen W. Buckman, Waverly; Roland N. Gibbs, Henderson, both of Ky.

[73] Assignee: Gibbs Die Casting Aluminum Corporation, Henderson, Ky.

[21] Appl. No.: 764,367

[22] Filed: Sep. 23, 1991

[51] Int. Cl.[5] ..... B22D 17/14; B22D 17/12

[52] U.S. Cl. ..... 164/120; 164/113; 164/133

[58] Field of Search ..... 164/63, 120, 305, 120, 164/113, 133, 312, 284, 257, 65

[56] References Cited

U.S. PATENT DOCUMENTS

| | | |
|---|---|---|
| 3,068,539 | 12/1962 | Wilcoxon . |
| 3,106,002 | 10/1963 | Bauer . |
| 3,209,416 | 10/1965 | Morton . |
| 3,268,960 | 8/1966 | Morton . |
| 3,387,646 | 6/1968 | Lauth . |
| 4,088,178 | 5/1978 | Ueno et al. . |
| 4,380,261 | 4/1983 | Suzuki et al. . |
| 4,446,907 | 5/1984 | Suzuki et al. . |
| 4,476,911 | 10/1984 | Lossack et al. . |
| 4,586,560 | 5/1986 | Ikeya et al. . |
| 4,932,458 | 6/1990 | Iwamoto et al. . |
| 4,955,426 | 9/1990 | Akimoto et al. . |
| 5,022,457 | 6/1991 | Iwamoto et al. . |

FOREIGN PATENT DOCUMENTS 1008610 10/1965 United Kingdom .

OTHER PUBLICATIONS

Paper No. 84–Application of Vacuum in Die Casting for Quality Improvement Westinghouse Electric Corp., Nov. 16–19, 1970.

Paper No. 1272–Vertical Die Casting Machines Kent A. Mulholland, Oct. 16–19, 1972.

Paper No. 86–Squeeze Casting I.I.T. Research Institute Nov. 16–19, 1970.

Paper No. G–T77–011—The Influence of Injection Cycle on Casting Quality Part I—The Effect of Shot Velocity and Timing on Die Venting and Casting Porosity, CSIRO–University of Melbourne, Jun. 6–9, 1977.

Paper No. G–T77–012—The Influence of Injection Cycle on Casting Quality Part II—The Effect of First Stage Conditions on Cavity Fill and Casting Porosity, CSIRO–University of Melbourne, Jun. 6–9, 1977.

Paper No. G–T83–061—Development and Application of Verticl Pressure Die Casting Process Toyota Motor Corporation, Oct. 31–Nov. 3, 1983.

Squeeze Cast Diesel Pistons M. F. McGuire, Sep. 1979.

Heat Treating of Nonferrous Metals ASM Committee on Heat Treating of Aluminum Alloys, no date.

Development of Medium Pressure Diecasting process (MP Process) Tokyo Light Metal Mfg. Co., Ltd., no date.

Squeeze Casting For Disc Brake Calipers SAE Technical Paper Series, Feb. 26–Mar. 2, 1990.

Development of Aluminum Alloy Roller Type Valve Rocker Arm by Casting and Forging Technique SAE Technical Paper Series, Feb. 27–Mar. 3, 1989.

Heat Treating Aluminum American Machinist Special Report No. 635, Oct. 6, 1989.

(List continued on next page.)

*Primary Examiner*—Richard K. Seidel
*Assistant Examiner*—Erik R. Puknys
*Attorney, Agent, or Firm*—Barnes & Thornburg

[57] ABSTRACT

An improved squeeze casting process is utilized to produce metal castings having superior mechanical properties. The process is particularly adapted for use in a vertical casting machine and is characterized by vacuum ladling, vacuum evacuated mold cavities, low metal temperatures, small metal feed gates and high gate velocities, application of high metal pressure on the metal filled cavity through the feed gate, and short processing times. When applied to aluminum alloy casting the squeeze casting process produces metal castings that can be heat treated at high temperatures to improve their mechanical characteristics.

23 Claims, 5 Drawing Sheets

OTHER PUBLICATIONS

Problems in Conventional Casting UBE Industries, Inc., no date.

Development of HVSC and Its Features UBE Industries, Inc., no date.

Paper No. G-T81-062—Vertical Die Casting Machine for Squeeze Casting UBE Industries, Ltd., Jun. 1-4, 1981.

Weingartner flyer no date.

Die Casting Machines Japanese Abstract WO 80/01655, Aug. 21, 1980.

Die Casting Method and Apparatus Japanese Abstract WO 80/01656, Aug. 21, 1980.

Die Casting Method Japanese Abstract WO 80/01657, Aug. 21, 1980.

Die Casting Method Japanese Abstract WO 80/01658, Aug. 21, 1980.

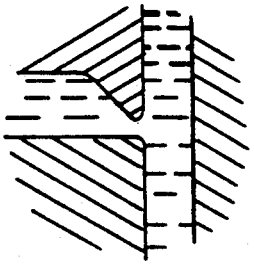
FIG. 3a
FIG. 3b
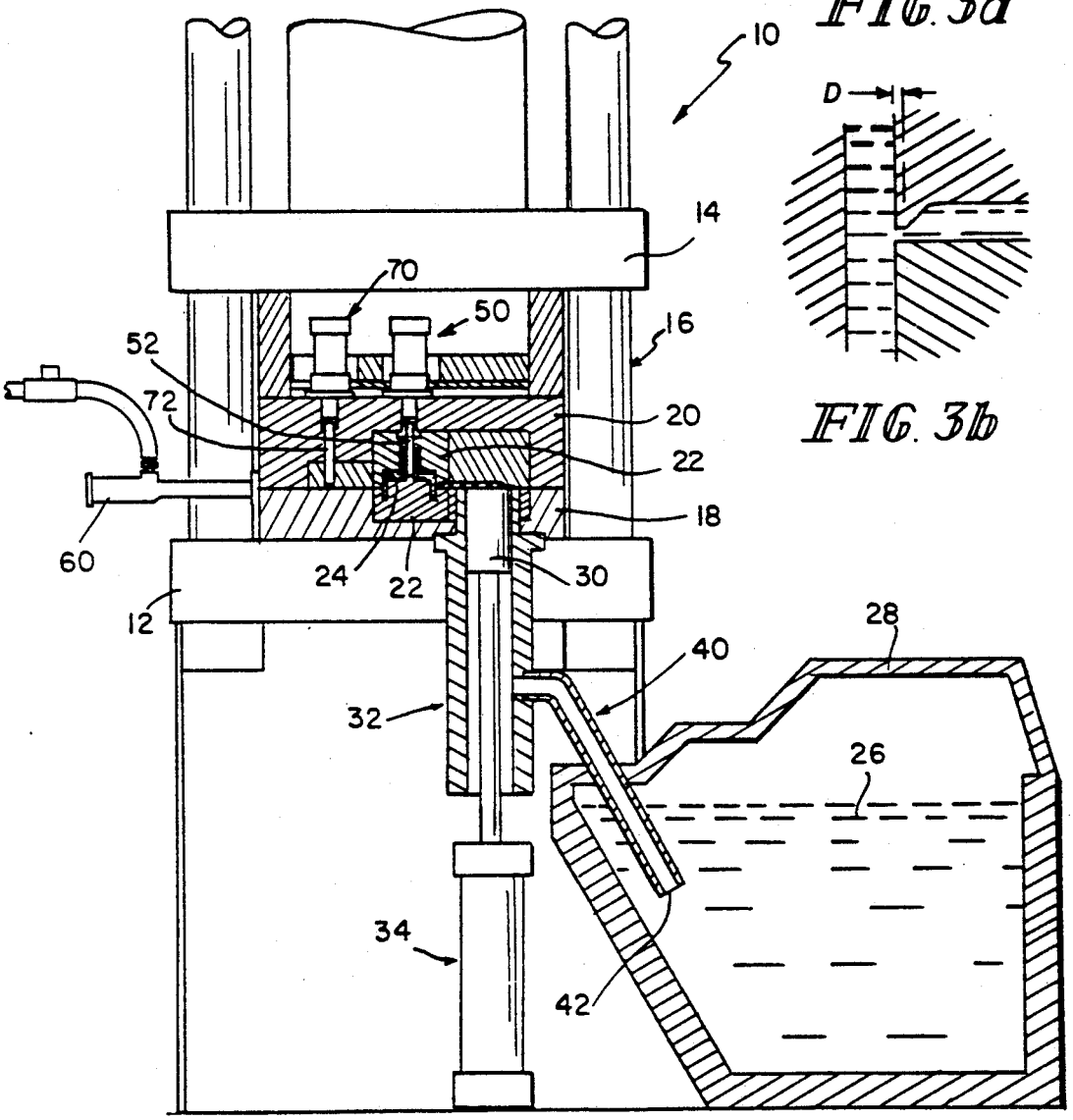
FIG. 3

VOLUME OF DIE FILLED
1.6
3.1
4.7
5.2
15.2
15.7
17.7
19.0
19.5
21.0
29.0
FREE FALL
LOCK UP
VACUUM LADLE
SHOT
INTENSIFIER
DWELL
DECOMPRESS
DIE OPEN
UNLOADER IN
EJECT
UNLOADER OUT
SPRAY
0
5
10
15
20
25
30
TIME IN SECONDS

CASTING PROCESS

BACKGROUND AND SUMMARY OF THE INVENTION

The present invention relates to casting processes, and more particularly to the provision of a high pressure die casting process which produces extremely fine-grained, dense castings with integrity competitive with forging and other more expensive casting processes. In specific, the present invention may be referred to as an improved squeeze casting or squeeze die casting process in which pressures as high as 12,000 to 20,000 psi or even higher are applied with the shot plunger or plunger to force metal into the die casting mold cavity. The process can be used to produce heat-treatable aluminum alloy coatings.

Die casting processes are very well known. The improved die casting process of the present invention makes use of a novel combination of conventional die casting process features and machines which are well known in the industry, but which need to be described in detail herein to provide the necessary background. To these well-known process features and machines, the present invention adds inventive control features and process controls to get the markedly improved die cast metal results. It is believed that no one heretofore has provided such a novel combination of process features and process controls and that no one has heretofore achieved such good casting structural integrity using low cost, high speed and volume die casting techniques.

In conventional die casting, a metal mold system having at least two parts forms a mold cavity into which molten metal is forced by pressure action of a shot plunger to fill the cavity where the metal is solidified to take the shape of the cavity. The advantages of such die casting are well known, particularly as they relate to high volume production and low cost. The disadvantages of die casting are also well known in that conventional die cast parts are known to have structural limitations, high porosity, etc. Even the best die casting processes, before the present invention, produced metal parts with some porosity and other structural integrity property problems. Aluminum alloy parts produced by such processes are typically not suitable for heat treatment using high temperatures.

In this specification, and in the appended claims, the following terms and their definitions shall apply unless specifically indicated otherwise:

Die Casting: A process involving the forcing of molten metal from a shot sleeve into a mold cavity formed in and by metal dies to have the metal solidify in the cavity to take its shape.

Squeeze Die Casting: A process of die casting involving the forcing of molten metal into the mold cavity under extremely high pressures in the range of about 10,000 to about 20,000 psi or even higher with the shot sleeve plunger which feeds the metal. This high pressure is applied while the metal is still molten at least in the metal feed gate which connects the cavity to the shot sleeve.

Vacuum Die Casting: The process of drawing a vacuum on the mold cavity and the passageways (runner system including the shot sleeve and transfer tube to the furnace) through which the molten metal is fed to remove air which might otherwise be trapped by the molten metal.

Vacuum Ladling: The process of using the vacuum system which evacuates the cavity and the runner system also to draw the molten metal into the 0 shot sleeve to be driven by the plunger which feeds the metal into the mold cavity.

Small Feed Gates: The gates through which the molten metal is driven into the mold cavity are said to be small gates when they have a cross-sectional area less than about 0.2 in.$^2$, more typically less than about 0.15 in.$^2$. For instance, small feed gates may be 1 in. wide and 0.060 in. to 0.125 in. tall, perhaps only 0.75 in. wide or a gate which is circular in cross section with a diameter of about 0.125 in. to 0.175 in., in other words, gates typically used in conventional die casting.

Large Feed Gate: In contrast, a large feed gate is a gate which has a cross-sectional area greater than about 0.25 in.$^2$; for example, it may be 1 in. wide and 0.60 in. tall.

Vacuum Gate: The very small gate through It typically has a cross-sectional area of less than 0.1 in.$^2$ and may be, for instance, about 0.500 in. wide and about 0.030 in. to 0.060 in. tall.

Slow Gate Velocity: The flow of molten metal through a feed gate is said to be slow when the velocity is about 0.1 ft. per second up to about 20 or 25 feet per second.

High Gate Velocity: The velocity of the molten metal through the feed gate is said to be high when the velocity is in ranges from about 40 ft. per second to about 150 ft. per second or even higher.

Shot Sleeve: The sleeve or cylinder into which the molten metal is drawn or vacuum ladled from the furnace to be driven by the shot plunger through the feed gate into the mold cavity. The shot sleeve is connected by a transfer tube to the molten metal in the furnace. In some cases, the shot sleeve is referred to as an "injection cylinder."

Intensification Pins: The pins used to intensify the pressure on the molten metal in the mold cavity after the small feed gate into the cavity is frozen (metal solidified) but before the thicker sections are frozen. The intensification pins are driven into the mold cavity space to apply extremely high localized pressures in the thicker sections penetrated by the pins.

Gravity Casting: Is a casting process in which the molten metal is poured into mold cavities and includes lost foam casting, permanent mold casting, sand casting, and lost wax casting processes. Certain aluminum alloys have been cast primarily in permanent mold casting in the past to produce high quality parts, but can now be die cast in accordance with the process of the present invention and subsequently heat treated with a high temperature. One such aluminum alloy is a 390 aluminum alloy which has a high silicon content.

Forging: Is a process using high heat and high impact blows to force a piece of metal into a particular shape to produce a high quality part. Forging and gravity casting are discussed herein to provide a comparison basis with which the low cost, high volume die cast parts made in accordance with the present invention compete favorably.

T-6 Heat Treating: Is a well known heat treating process widely used to heat treat aluminum alloy castings made in the permanent mold casting process or forging processes. It is conventional thinking in the aluminum die casting industry that aluminum parts made by conventional die casting cannot be heat treated in accordance with T-6 heat treating processes. The process involves holding the parts at high temperatures of 920° F. to 925° F. for long periods of time, typically up to about 12 hours, followed by a water quench and after 24 hours a second heat treatment at about 350° F. for about 8 hours. It is believed that this T-6 heat treating process causes the copper and magnesium to go back into solution to make the microstructure harder and stronger and also to make the silicon particles less needle-like. The industry accepts that conventional die casting parts cannot be heat treated with the T-6 heat treating process because of the porosity which will produce blisters.

Cool Water Quench: Is a quenching process involved in the T-6 heat treating process which normally uses water held at about 200° F. Cool water quenching involves quenching in water held at, for instance, 100° F. to 120° F. within a short period of time of, for instance, ten seconds or so after the part is removed from the furnace where it is held at 920° F. to 925° F.

VERTI-CAST Machines: Are the die cast machines known in the trade for their vertical orientation, particularly an orientation in which the upper and lower molds are carried, respectively, on upper and lower platens to provide a plurality of mold cavities peripherally spaced about a vertical center axis with a vertically arranged shot sleeve and injection plunger for forcing the molten metal upwardly into the concentrically arranged mold cavities.

High Temperature Metal: Is metal held in a die casting furnace at a temperature well above the temperature at which the metal starts to solidify, perhaps as much as 200° or more above that temperature, and injected into the mold cavity at the high temperature. For example, 390 aluminum alloy has a freezing point of 945°, and it begins to solidify at 1200° F. Thus, high temperature 390 aluminum alloy would be held at a temperature of about 1400° or above.

Low Temperature Metal: Is metal held in a die casting furnace at temperatures not more than about 100° F. above the temperature at which the metal starts to solidify , and typically not more than about 15° F. to about 50° F., above the temperature at which the metal starts to solidify, and injected into the mold cavity at the low temperature. The temperature difference between the freezing point of a metal and the point at which the metal starts to solidify is dependent on metal alloy composition. Generally it ranges from as little as about 15° up to about 250° in aluminum alloys.

It is known to accomplish squeeze die casting of aluminum alloy using large metal feed gates, slow gate velocities, high temperatures and squeeze pressures by the shot plunger in the range of 10,000 to 20,000 psi on the metal. These squeeze die castings are reported to use molten metal at a high temperature, for example, in the range of 1460° F., low gate velocities with the large metal feed gates. The metal being injected at 1460° F., which is approximately 200° F. above the point at which the metal begins to solidify, takes much longer to chill and the squeeze pressure is applied over a much longer period of time because, generally speaking, the metal in the large feed gate is typically the last section on the whole casting to freeze. The squeeze pressure pushes molten metal into the cavity as the metal cools and shrinks. One problem is that the high temperature of 1460° F. requires exceptionally long chilling periods and consequent slower production rates. The high temperature metal also wears the molds.

In squeeze die casting in accordance with the present invention, the metal is injected at a low metal temperature—about 1260° F. or, perhaps, 1270° F. ±20° F. for a 390 Alloy aluminum. The molten metal is vacuum ladled from the center of the mass of molten metal quickly into the shot sleeve and very quickly driven at high pressure through the small feed gates into the mold cavity. Because the combination of low metal temperature and small feed gates results in faster feed gate freezing, the squeeze pressure is applied over a very short period of time.

There are many examples in the prior art of conventional die casting processes which have included some or even most of the process steps, features and controls of the present invention. For example, it is known to have conventional die casting with vacuum evacuation, vacuum ladling, small feed gates, small vacuum gates and high gate velocities without the squeeze pressures of, for instance, 10,000 to 20,000 psi. It is known that some Japanese die casters use such conventional die casting processes, even involving squeeze die casting high pressures on the shot plunger, with small feed gates and high gate velocities, but without using vacuum evacuation and vacuum ladling which is a prominent feature of the combination of steps of the present invention. Such conventional die casting in Japan, even using squeeze die casting plunger pressures, have been reported not to be heat treatable in accordance with the T-6 heat treating processes. In fact, in order to accomplish T-6 heat treating, the Japanese die casters reported having to switch to the above-described squeeze die casting process involving use of large metal feed gates, relatively slow gate velocities, extremely high temperatures and squeeze pressures by the shot plunger.

While many or even most of the process steps and features of the present invention are known in the die cast industry and, in fact, widely used, no one heretofore has used the claimed combination of process steps and features of the present invention to obtain such remarkably good results in a die casting machine environment using low temperature metal for the molten metal which is ideally suited for high volume production. Die cast parts made in accordance with the present invention have been compared, for instance, to similar parts made by forging, and found to be remarkably superior to the forged parts in deformation characteristics. While the squeeze die cast parts produced in accordance with the die cast process of the present invention are significantly improved, it has been found that they can be even more significantly improved using the T-6 heat treating process which conventional knowledge says is not applicable to die cast aluminum parts.

The squeeze die casting process of the present invention may preferably be carried out on what is known in the trade as a VERTI-CAST machine to be described hereinafter. However, it is believed that the process can be carried out with equal efficiency on horizontal casting machines that have been modified for vacuum die evacuation ladeling. In vertical casting machines, modified in accordance with the present invention, low temperature metal is drawn by vacuum (vacuum ladled) from the adjacent furnace through the transfer sleeve into the vertically extending shot sleeve to be driven by the vertically upwardly driven plunger to feed the mold cavities through the metal feed gates and runner system arranged concentrically about the center of the shot sleeve. The low temperature metal is driven under pressure applied by the plunger at high velocity through a small feed gate into the evacuated mold cavities. After the mold cavities are filled, the plunger is used to apply high pressure to the metal as it begins to freeze in the mold cavities. The low temperature metal freezes relatively quickly in the small feed gate.

Consistent metal alloy composition is important to optimum performance of the present process, just as it is with other casting processes known in the art. Preferably the molten metal in the furnace is cleaned and degassed using well-known industry techniques and the metal temperature is carefully controlled as indicated above. The objective is to have very clean and gas free metal of consistent alloy composition.

In accordance with the present invention, the entire process of drawing a vacuum on the mold cavities, the feed gate and runner system, the shot sleeve and the transfer tube to suck the molten metal upwardly through the transfer tube into the shot sleeve, the actuation of the plunger to drive the molten metal upwardly into the mold cavities, and the application of the high pressure or squeeze pressure by the plunger and to permit the metal to solidify during a dwell time before the die opens and the part is ejected onto a shuttle tray takes a very short period of time in accordance with the present invention. For instance, the vacuum ladling step may have an effective duration of approximately 1.6 seconds in a typical operation in accordance with the present invention while the shot time or the time it takes for the plunger to drive the molten metal from the shot sleeve into the mold cavities may take only 0.5 seconds duration in a typical application in accordance with the present invention. The squeeze pressure may occur, for instance, only 0.003 seconds before the shot is completed or the mold cavities are filled, and the squeeze pressure may take place over the dwell time, for instance, of ten seconds. It will be seen that, in a typical application in accordance with the present invention, the molten metal may be ladled upwardly by the vacuum and shot into the mold cavities in about 2.0 to 2.3 seconds, which is extremely fast. Of course, the squeeze pressure can be released after metal freezes in the small feed gate.

As this description progresses, it will be appreciated that the squeeze die casting process of the present invention is carried out at the relatively low temperatures normally associated with conventional die casting and not at the high temperatures normally associated with squeeze casting. Since the molten metal is maintained in the furnace in accordance with the present invention at a point just above the point where solidification will begin, the rapid vacuum ladling and rapid plunger injection of the molten metal into the mold cavities is required to fill the mold cavities with still molten metal which can be acted upon by the squeeze pressures applied by the plunger as the metal solidifies. Of course, when the metal solidifies and closes or freezes the metal feed gates, further plunger pressure, no matter how high it is, will have no effect on the metal in the mold cavities. It should also be noted that when the molten metal first enters the mold cavities, it will begin to exit through the above-described vacuum gates which are quite small and exit out into the vacuum runner where the metal will quickly be solidified to block further exit of the metal through the vacuum gate.

Thus, in accordance with the present invention, in about two seconds or even less in some cases, the desired amount of molten metal is vacuum ladled or drawn from the center of the melt of the furnace, through the transfer tube, and into the shot sleeve where the first movement upwardly of the shot plunger shuts off the metal flow from the transfer tube, controlling the amount of metal ladled. The upward movement of the plunger, which may take place over about 0.5 seconds, pushes the low temperature metal into air and gas-free mold cavities to quickly fill the cavities, and then high squeeze pressure is immediately brought to bear on the freezing metal. It will be appreciated that, in accordance with the present invention, all of the various actions of the die cast machine may be controlled by dwell timers of conventional variety to cause the process steps to occur in a rapid and timely manner. For instance, the shot speed or speed of the drive plunger may be, for instance, 5 ft. per second to obtain a gate feed velocity of 100 ft. per second with a mold cavity fill time of less than about 0.5 second, for example, about 0.15 second.

It is an object of the present invention, therefore, to provide a process for casting aluminum alloy metal in a die casting apparatus of the type comprising at least a pair of dies forming at least one cavity therebetween having a vacuum gate and a metal feed gate and a runner communicating with the metal feed gate for delivery of molten metal into the cavity, a source of molten metal, a charge sleeve or shot sleeve communicating with said runner for receiving molten metal from the source and directing it through the runner to the feed gate into the cavity, the feed gate controlling the flow of metal from the runner into the cavity, a plunger reciprocally disposed in the sleeve and means for applying pressure to the plunger to force the molten metal under pressure through the runner and metal feed gate into the cavity, and a vacuum source and means for connecting the vacuum source to the vacuum gate, cavity, runner and shot sleeve to remove gases therefrom and to ladle or draw the molten metal from its source into the sleeve in a position to be driven by the plunger. In this equipment just described, the process of the present invention comprises the steps of controlling the plunger as it drives molten metal through the metal feed gate to control the gate velocity into the cavity initially to fill the cavity, dimensioning the metal feed gate to provide a high velocity feed from about 40 ft. per second to about 150 ft. per second into the mold cavity during the initial cavity filling step, and just before, or just as, the cavity is filled, increasing the pressure on the metal up to about 10,000 to 20,000 psi using the shot plunger to force additional molten metal through the feed gate during the pressure increasing step and during the very rapid freezing of the low temperature metal in the mold cavity. The metal in the gate solidifies after the pressure increasing step, but preferably not before the substantial freezing of the metal in the cavity.

Another object of the present invention is to provide such a process for die casting heat treatable aluminum alloy and subsequently subjecting the die cast part to heat treating in accordance with T-6 heat treatment procedures. It has been found that a squeeze die cast part made in accordance with the process of the present invention and heat treated in accordance with T-6 heat treating processes will take a 390 aluminum alloy from its known conventional yield strength of 35,000 psi to a remarkably high 51,000 psi. In a specific comparison test, a normal 390 aluminum alloy ASTM test bar has a standard 35,000 psi yield strength. A similar die cast ASTM test bar made in accordance with the squeeze die casting process of the present invention and subjected to T-6 heat treating produced such remarkably good yield strength results. As indicated above, the industry has not been able to heat treat aluminum die cast aluminum parts in accordance with T-6 heat treating processes before the present invention.

It is, therefore, still another object of the present invention to provide a novel combination of process steps for making a squeeze die cast part from heat treatable aluminum alloy and then to heat treat that aluminum part in accordance with T-6 heat treating process steps.

While such improved castings may possibly be further improved with intensification pins or squeeze pins as they are known, such remarkably good results are being obtained with the process of the present invention, and the intensification pins may not be required in some cases.

A further object of the present invention is to provide such process steps in a rapid and timely manner using relatively cool, for squeeze die cast temperatures, molten metal which quickly solidifies after it is injected into the mold.

It is still another object of the present invention to provide such a squeeze die cast process for casting aluminum alloy metal wherein a cavity of volume $V_c$, in a mold having a vacuum gate and a metal feed gate communicating with the cavity is first evacuated by applying a vacuum to the vacuum gate and thereafter filled through the feed gate with molten metal under pressure $P_1$ at a low metal temperature T above the temperature $T_s$ where the metal begins to solidify. $P_1$ is selected to achieve a high gate velocity. In this environment, the improvement comprises the steps of increasing the pressure of the metal flowing through the metal feed gate to pressure $P_2$ about when the volume of the metal filled into the cavity is about $V_c$, the goal being to continue to force the low temperature molten metal through the feed gate during the very short period of time over which the low temperature metal freezes on the mold. In this recited process, the vacuum accomplishes the vacuum ladling of the molten aluminum alloy metal into the shot sleeve directly from or near the center of mass of molten metal in the furnace. The vacuum ladling and the plunger feeding of metal through the feed gates occurs very rapidly as discussed above. The dimensioning of the feed gate is such that, as the pressure of the low temperature metal is increased from $P_1$ to $P_2$, and concomitantly during the rapid freezing of the metal in the mold, the velocity of the molten metal through the gate is such that the temperature of the metal in the gate is greater than $T_f$, the temperature at which the metal freezes, and the velocity of the metal in the gate at a point in time after $P_2$ is reached is such that the temperature of the metal in the feed gate is less than or equal to $T_f$ whereby the cavity containing pressurized metal is sealed by metal freezing in the feed gate. In this process, the pressure increase to $P_2$ is typically effected by timer actuation to drive more molten metal through the feed gate, of course, at a much slower gate velocity after the volume of metal injected into the mold equals $V_c$. Ideally, the flow of metal through the small feed gate is not interrupted until the temperature of the metal in the mold at $P_2$ is $\leqq T_f$. Molten aluminum alloys can begin to solidify at temperatures, $T_s$, ranging from about 1080° to about 1200° F. while metal freezing temperatures, $T_f$, range from about 945° to about 1065° F., depending on alloy composition.

Other objects and features of the present invention will become apparent as this description progresses.

BRIEF DESCRIPTION OF THE DRAWINGS

The detailed description particularly refers to the figures in which:

FIG. 3 is a sectional view similar to FIG. 1 showing the movement of the plunger upwardly to drive the molten into the mold cavity;

FIG. 3*a* shows a typical feed gate cross section;

FIG. 3*b* shows a typical vacuum gate cross section;

FIG. 1 also illustrates an intensification cylinder 50 for driving an intensification pin 52 into the mold cavity 24 for reasons discussed hereinabove. Depending upon the size of the mold cavity, one or more intensification pins may be driven into the mass of molten metal at extremely high pressures after the metal feed gate is frozen further to intensify the pressure on the metal as it solidifies at locations surrounding the protruding intensification pin. FIG. 1 also shows a vacuum port line 60 connected to the mold cavity 24 through the die halves, 18, 20 in conventional fashion so that the cavity 24, the shot sleeve 32 and the transfer tube 40 may be evacuated. When this happens, the atmospheric pressure acting on the mass of molten metal 26 in the furnace 28 will drive the molten metal upwardly through the transfer tube 40 into the shot sleeve 32 as best seen in FIG. 2. Particularly, evacuation of air and gases from the sleeve 32, runner system 62 and mold cavity 24 is started by a pressure switch indicating that the seal is effective or that, in fact, the die halves 18, 20 are fully closed to provide a seal. This suction action of the vacuum creates a vacuum in the mold cavity 24, runner system 62 (FIG. 2) and shot sleeve 32 to draw the molten aluminum into the sleeve via the transfer tube 40 in about 1–3

Figure 1:
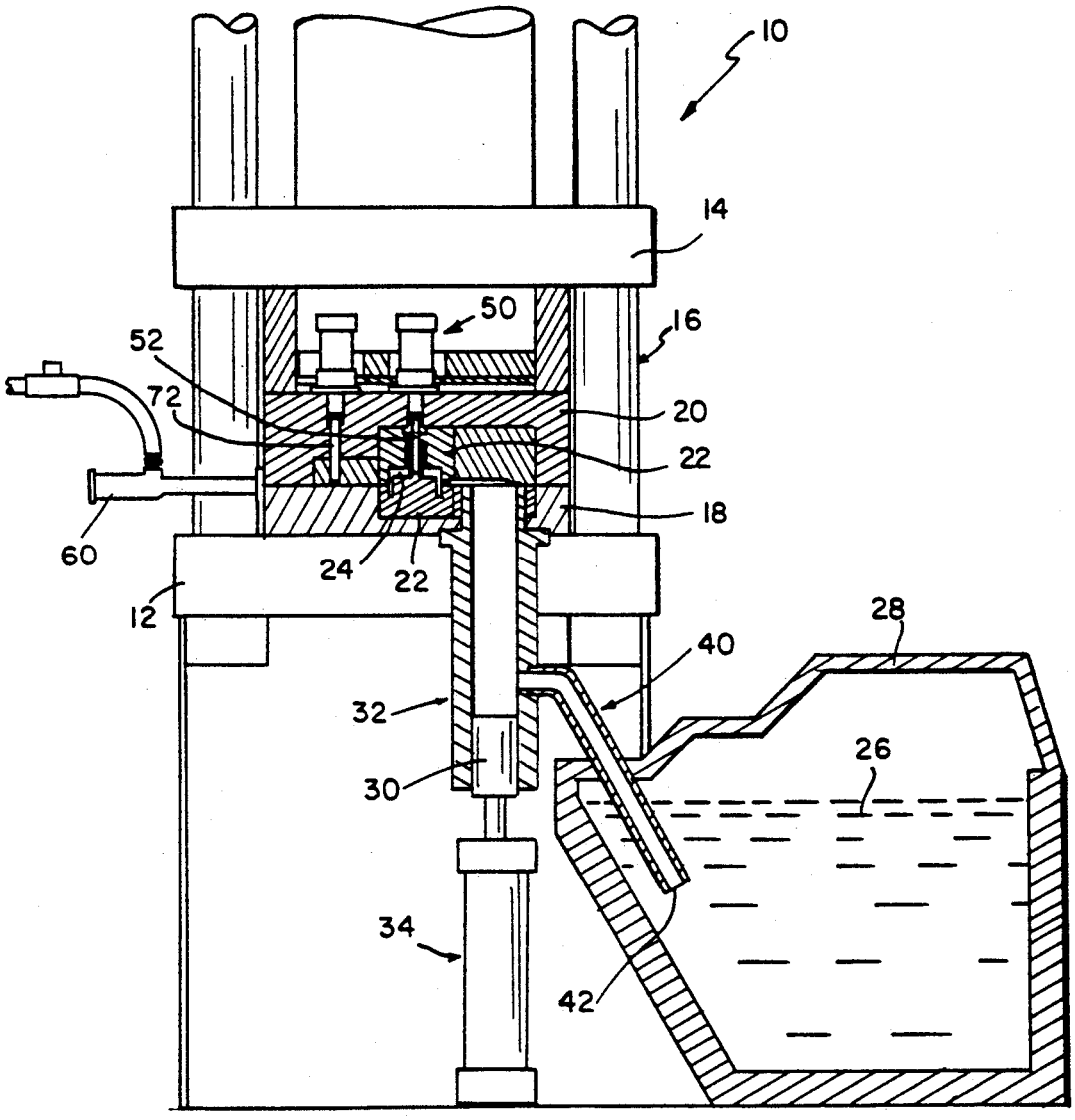
FIG. 1 is a sectional view of a VERTI-CAST machine arranged in accordance with the present invention showing the holding furnace next to the machine, and also showing the status of the machine when the upper platen is in its lower position against the lower, stationary platen to start the die cast process.
Figure 2:
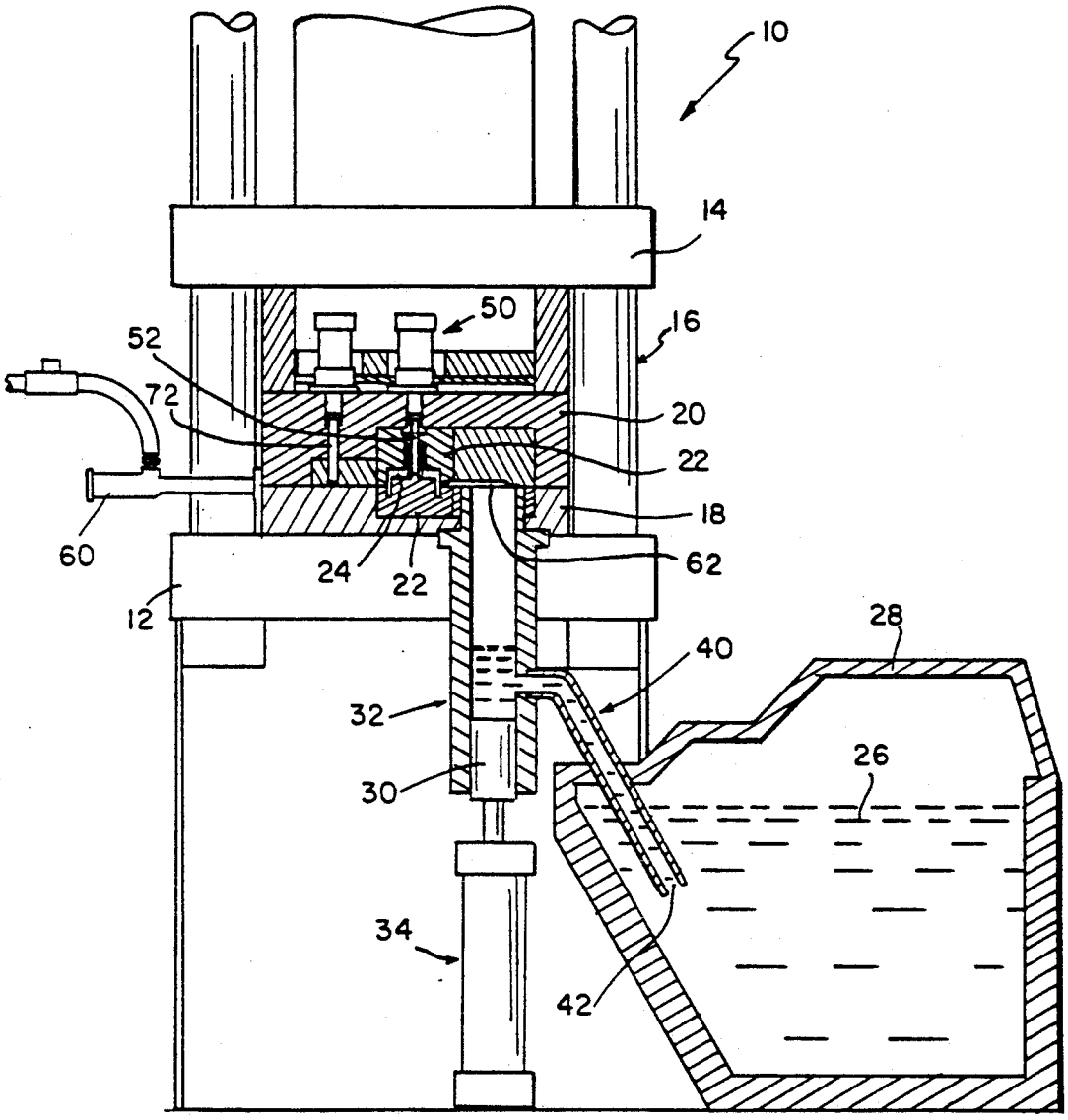
FIG. 2 is a sectional view similar to FIG. 1 and showing what happens during the vacuum application and vacuum ladling phase of the process, particularly the drawing of the molten metal upwardly into the shot sleeve through the transfer tube.

It will be appreciated, as this seconds. As indicated above, these steps may be timer controlled.

It will be appreciated, as this description progresses, that the action of the plunger 30 in moving the molten metal upwardly through the runner system 62 into the mold cavity 24 must occur rather rapidly because the suction action will actually start drawing the molten metal upwardly into the cavity where the metal will begin to solidify. In other words, the vacuum ladling activity must be very quickly followed by the shot plunger 30 movement upwardly in the shot sleeve 32 because the molten metal will begin to solidify as soon as it leaves the furnace 28.

Turning to FIG. 3, it will be seen that the first movement upwardly of the plunger 30 shuts off the metal flow from the transfer tube 40, controlling the amount of metal ladled into the sleeve 32. Ideal gate size and metal velocity through the gate are determined through various quality studies. Vacuum is shut off by the vacuum shut-off cylinder 70 driving shut-off pin 72 or by use of a chill block (not shown) in the vacuum runner. The vacuum valve cylinder 70 may be closed shortly before the die opens. It will be appreciated that the action of the shot plunger 30, which is rather quick in starting after the ladling and rather rapid, drives the low temperature metal through the runner system 62 into the mold cavity 24 out through the vacuum gate into the vacuum runner formed by the die halves 18,20. When that stream of molten metal reaches the shut-off pin 72 or the chill block, the vacuum is terminated by the freezing metal.

FIGS. 3*a* and 3*b* illustrate typical metal feed gates and vacuum gates, respectively, for use in accordance with the present invention with the metal feed gate having, for instance, a height of 0.060 in. and a width (into the paper) of, perhaps, 0.75 in. or even 0.100 in. FIG. 3*a*, therefore, illustrates a small metal feed gate. FIG. 3*b* illustrates an even smaller vacuum gate with a thickness or height of 0.045 in. and a width (into the paper) of, perhaps, 0.750 in. to 0.100 in. In die casting, a metal feed gate or a vacuum gate are relatively small openings from runner system 62 directly into the mold cavity 24. Preferably the gate land (dimension D) is about 0.030 in. While the runner system 62 may provide substantial width, it has been found that reducing the runner system in size to define a small metal feed gate is very attractive for several reasons. Not only does it provide the relatively high metal feed gate velocity 5 which is attractive in accordance with the present invention, but it also provides but a relatively small and frail gate section which needs to be broken or cut away from the cast part.

It is believed that, in accordance with the present invention, the molten metal under the plunger-applied pressure moves through the feed gate at such high velocity that the molten metal actually sprays into the mold cavity 24 to fill the cavity. This spraying action into the vacuum evacuated cavity 24 is believed to contribute to the good structural integrity and lack of porosity produced by the present invention.

Figure 4:
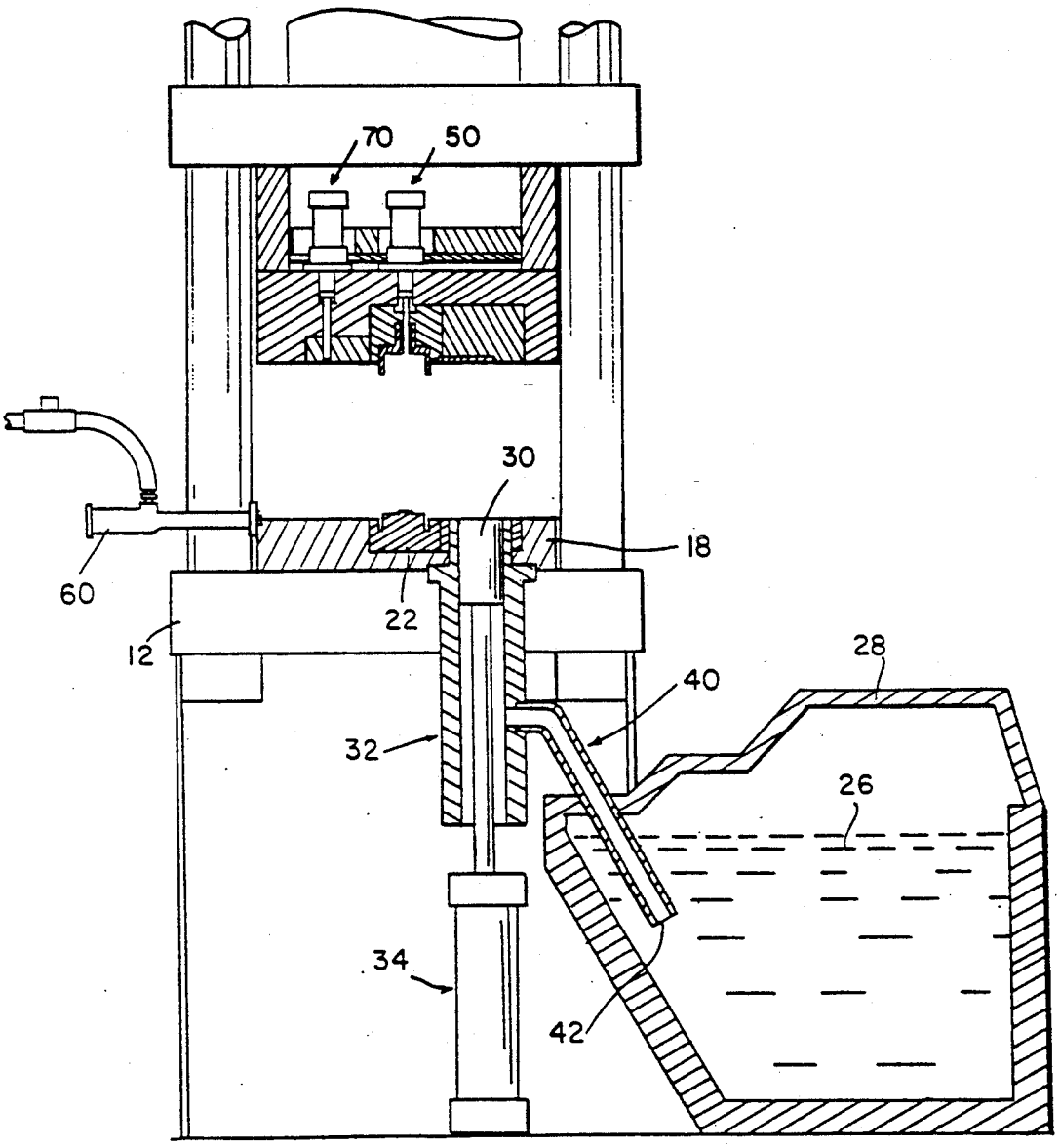
FIG. 4 shows a sectional view similar to FIG. 1 with the upper platen in its upper position to open the die where the plunger also moves upwardly to push the casting from the cavity mold.

In FIG. 4, the upper platen 14 is raised to open the die (vertically separate the ejector die half 20 from the cover die half 18) to expose the cavity 24 and the metal casting therein. The plunger 3 is shown moved to its uppermost position which pushes the solidified casting upwardly so that it can be taken off the press. The process can then be reinitiated to move the various components back to the position shown in FIG. 1.

Figure 5:
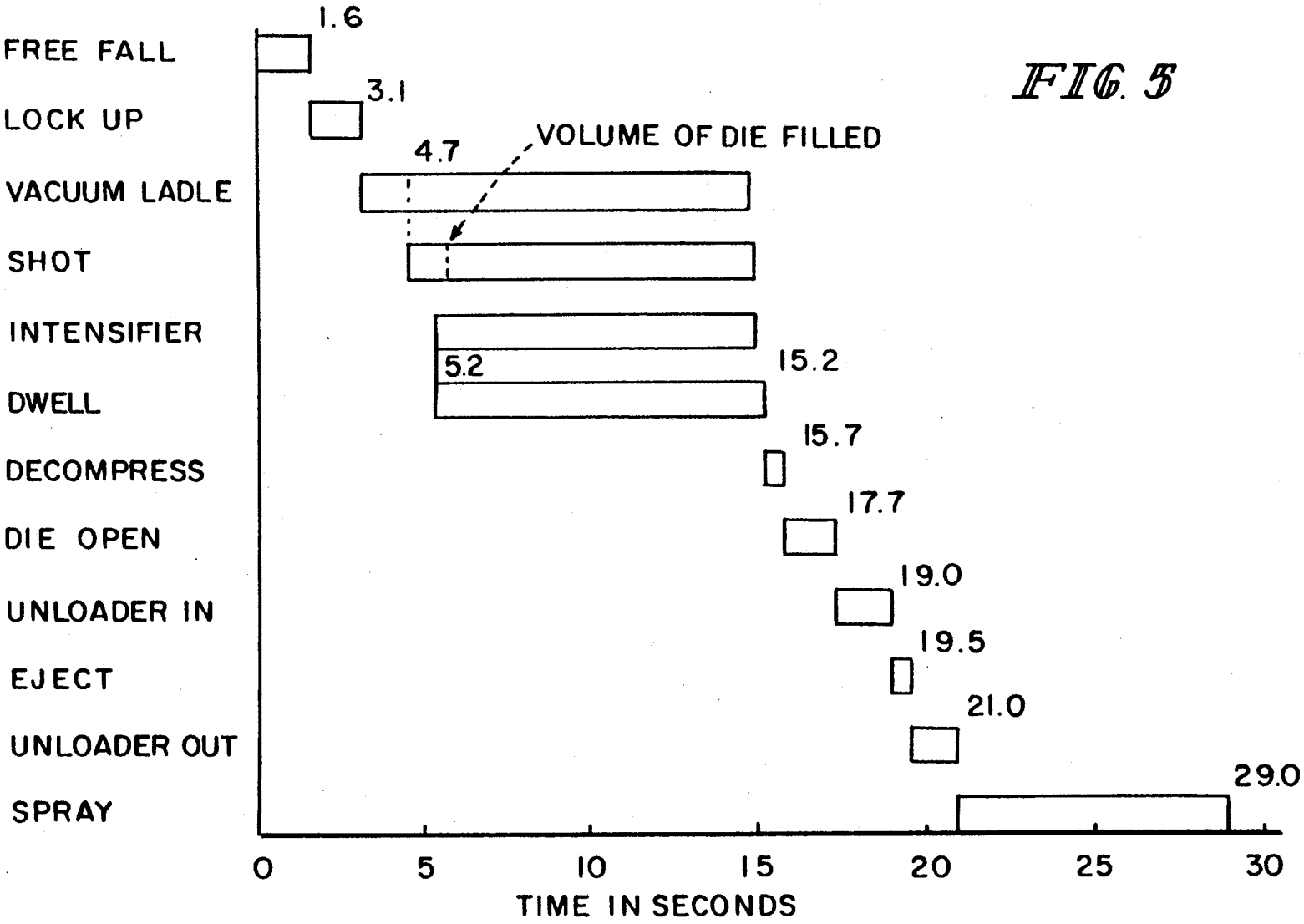
FIG. 5 is a casting cycle time line chart showing the time sequence and duration of the above-described process steps; and Referring specifically to FIG. 1, it will be seen that the VERTI-CAST machine 10 comprises a lower, stationary platen 12 below a vertically movable platen 14 with a set of die parts 16 disposed between the platens. The die parts 16, in many respects, are conventional and comprise a cover die half 18 on the stationary platen 12, an ejector die half 20 attached to the movable platen 14 with cavity blocks 22 carried by the die halves 18, 20 in a known and conventional manner to define at least one mold cavity 24. It is this at least one mold cavity 24 into which low temperature metal 26 from the furnace 28 is to be injected by the shot plunger 30 operable in the shot sleeve 32 and driven by a hydraulic cylinder 34 capable of maintaining a high pressure on the low temperature metal 26 as it is injected into the mold and further capable of applying a higher pressure on the metal in the filled mold cavity. The shot sleeve 32 is connected by a transfer tube 40 to a point 42 well down into the mass of molten aluminum in the furnace 28.

FIG. 5 shows a Casting Cycle Time Line to illustrate how fast the inventive process of the present invention takes place. The chart shows the various functions which occur to the left beside the vertical axis with the various steps listed in the order in which they occur. The first step, referred to as FREE FALL is the lowering of the platen 14 to its position which closes the die set 16 for LOCK UP step indicated. In a typical system, FREE FALL may take 1.6 seconds while LOCK UP may take 1.5 seconds. Thus, after 3.1 seconds, with the system sealed, the VACUUM LADLE step can begin and take place over a duration of 1.6 seconds to bring the total cycle time to 4.7 seconds. The vacuum will remain on, as indicated in the chart, until it is shut off as discussed above. The SHOT step will typically be initiated, for example, very quickly over a period of 0.5 seconds to provide a cycle time at that point, when the cavity 24 is filled, of 5.2 seconds. The INTENSIFIER step may then be initiated, for example, within 0.003 seconds of the completion the SHOT step, and the squeeze pressure may be held by plunger for a considerable period of time as shown by the chart, for instance, to the end of the DWELL time. The INTENSIFIER step should be initiated just as the shot stroke is completed so that the flow of metal through the gate is not interrupted.

The DWELL time of ten seconds is the time over which the molten metal solidifies to the point it can be sufficiently rigid to be removed from the cavity 24. Thereafter, other steps such as DECOMPRESSION, DIE OPEN, UNLOADER IN, EJECT, UNLOADER OUT, and SPRAY may typically take the times shown. While all of the steps from DECOMPRESSION through SPRAY are typical steps not necessarily involved in the process of the present invention, they do show how quickly a die cast system can be cycled to start another cycle of casting molten metal. It will be appreciated that the DWELL of ten seconds would need to be substantially increased if the molten metal were injected at temperatures considerably higher, for instance, the temperature of high temperature metal.

It has been found that squeeze die cast parts made in accordance with the present invention and on the machinery described above with the cycle times shown in FIG. 5 and with the small feed gates, high gate velocities, low temperature metal, vacuum ladling and high squeeze pressures will produce die cast parts having remarkably improved structural integrity and porosity characteristics. These parts, when cast from a heat treatable aluminum alloy having a freezing point of about 945° to about 1200° F., such as a 390 aluminum alloy, can then be further improved by heat treating in accordance with T-6 heat treating process discussed above, particularly with the cool water quench which takes place quickly for instance within about 10 seconds or a similar short time which will not permit significant cooling after the long soaking at the high temperature involved in T-6 heat treating for the required period of time.

It has been found that increasing the feed gate velocity is quite important to producing castings having good structural integrity and good porosity characteristics. Essentially, with a given shot plunger 30 size and pressure and stroke speed, it has been found that making the feed gates smaller to increase the metal flow velocity through the gate improves the casting's characteristics. In fact, it has been found that, using the process features and steps of the present invention, the castings are not getting the usual shrinkage, even in the thick casting sections away from the feed gate, found in conventional die cast parts. This unexpected and beneficial result, which may eliminate the need for the high maintenance intensification pins 52 for the thick sections away from the feed gate, is believed to derive from the unique combination of process steps, and particularly the evacuated die cavity which is accomplished in the vacuum ladling, the use of low metal temperature, the high gate velocity which is believed to create the aforementioned metal spray into the cavity and the very quick and fast action at providing the high squeeze pressures.

The novel combination of steps of the present invention works well with certain hypereutectic metal alloys such as a 390 aluminum alloy. Essentially, a hypereutectic aluminum alloy is an alloy which will hold its eutectic state longer, i.e., the state at which the metal is at the same temperature in both its liquid and solid state. At this eutectic state, when the metal is, perhaps, at or even just below the point at which it begins to solidify, the squeeze pressure provided by the plunger 30 adds even more pressure on the metal in the cavity after the metal normally should be freezing.

It is believed that the process of the present invention should improve the characteristics of most heat treatable aluminum alloys. While a 390 aluminum alloy has been discussed herein, it will be appreciated that there are other aluminum alloys which have similar characteristics. The 390 aluminum alloy, which is normally heat treated after permanent mold casting or after forging, can now be squeeze die cast in a high volume, low cost apparatus and then heat treated in accordance with T-6 heat processes.

Other alloys, such as a 356 aluminum alloy can similarly be improved by die casting in accordance with the present invention and then further improved by heat treating by the T-6 process. It has been found that a 356 aluminum alloy, which has been permanent mold cast and then heat treated in accordance with the T-6 heat treating procedures will have a given yield strength well known in the trade. It has also been found that a 356 aluminum alloy cast in accordance with the die casting process of the present invention will have even greater strength than the permanent mold cast part with the T-6 heat treating. Then, heat treating the squeeze die cast part cast in accordance with the present invention with the T-6 heat treating process produced even greater strength results.

We claim:

1. A process for manufacture of molded metal castings in a die-casting apparatus of the type comprising at least a pair of dies forming at least one cavity therebetween having a vacuum gate and a metal feed gate and a runner communicating with the metal feed gate for delivery of molten metal into the cavity, a source of molten metal, a charge sleeve communicating with said molten metal source and said runner for receiving molten metal from said source and directing it through the runner to said feed gate into said cavity, said feed gate controlling the flow of metal from said runner into said cavity, a plunger reciprocally disposed in said sleeve and means for applying pressure to said plunger to force the molten metal under pressure through said runner and metal feed gate into said cavity, a vacuum source communicating with said vacuum gate, cavity, feed gate, runner and sleeve to remove gases therefrom and with sufficient suction quickly to draw the molten metal from its source into said sleeve in a position to be driven by said plunger, the process comprising the steps of drawing the vacuum to ladle the molten metal into said sleeve in an amount of time to prevent any appreciable solidifying of the molten metal, immediately actuating said plunger as soon as a molten metal charge is ladled into said sleeve to drive molten metal through said metal feed gate to control the gate velocity into the cavity initially to fill said cavity, and thereafter increasing said pressure on said plunger at least up to about 10,000 psi on the molten metal to force additional molten metal through said feed gate, controlling the temperature of the molten metal at less than about 100° F. above the temperature at which the metal begins to solidify, selecting the metal feed gate to have a cross-sectional area such that with the plunger actuation molten metal is fed at a velocity of about 40 to about 150 feet/second into said cavity during the cavity filling step and such that molten metal flows through said feed gate during the pressure increasing step and removing the resulting casting from the cavity after allowing the pressurized metal in the cavity to solidify.

2. The process of claim 1 further comprising the step of heat treating the metal casting to improve the mechanical properties of the casting.

3. The process of claim 1 wherein the die-casting apparatus is a vertical die-casting machine.

4. The process of claim 1 wherein the feed gate is dimensioned to have a cross-sectional area of less than about 0.2 in.$^2$.

5. A process for die casting metal with a plunger acting on molten metal in a shot sleeve communicating through a metal feed gate with a cavity of volume $V_c$ in a mold having a vacuum gate and vacuum source sufficient to ladle molten metal into said shot sleeve in which process the cavity is first evacuated by applying a vacuum to said vacuum gate and thereafter filled by the action of said plunger in said shot sleeve to drive molten metal under pressure $P_1$ at a temperature T above the temperature $T_s$ at which the molten metal begins to solidify through said feed gate at gate velocity of greater than about 40 feet/second, and further comprising the steps of controlling the temperature T of the molten metal to a temperature less than about 100° F. above the temperature $T_s$ at which the molten begins to solidify, increasing the pressure of the metal flowing through said feed gate to pressure $P_2$ as the volume of the metal filled into to the cavity is about $V_c$, and selecting the feed gate to have a cross-sectional area so that as the pressure of the molten metal is increased from $P_1$ to $P_2$ and during shrinkage of the freezing metal in the mold, the velocity of the molten metal through said gate is such that the temperature of the metal in the gate is greater than the temperature at which the molten metal freezes, $T_f$.

6. The process of claim 5 wherein the feed gate is dimensioned so that at $P_1$ the molten metal is delivered through the gate at a velocity of from about 40 feet/-second to about 150 feet/second.

7. The process of claim 5 wherein the pressure $P_2$ on the metal is about 10,000 to about 20,000 psi.

8. The process of claim 5 wherein said process is carried out in a vertical casting machine.

9. The process of claim 5 in which the metal is a heat treatable aluminum alloy which begins to solidify at a temperature $T_s$ of about 1080 to about 1200° F.

10. The process of claim 5 further comprising the step of constructing said mold to have one or more intensification pins and forcing said intensification pins into said cavity after the temperature of the metal in the feed gate is less than or equal to $T_f$.

11. The process of claim 9 further comprising the step of heating the metal casting to improve the mechanical properties of the casting.

12. The process of claim 5 wherein the feed gate is dimensioned to have a cross-sectional area of less than about 0.15 in$^2$.

13. In a process for die casting aluminum alloy metal with a plunger acting in a shot sleeve wherein a cavity of volume $V_c$ in a mold having a vacuum gate and a metal feed gate communicating with the cavity is first evacuated by applying a vacuum to said vacuum gate sufficient quickly to ladle molten metal into said shot sleeve and thereafter filled through said feed gate with a molten metal under pressure $P_1$ at a temperature T above its freezing point $T_f$, the improvement comprising the steps of controlling the temperature T of the molten metal to be less than about 1300° F., increasing the pressure of the metal flowing through said feed gate to pressure $P_2$ when the volume of metal filled into the cavity at $P_1$ is about $V_c$, and selecting the feed gate to have a cross-sectional area so that the velocity of the molten metal through the feed gate due to the movement of said plunger is sufficiently high to spray the metal into said cavity and, as the pressurized metal cools and contracts is such that the temperature of the metal in the gate remains greater than $T_f$ for a finite period of time following application of pressure $P_2$ to permit sufficient squeeze action to produce a low porosity casting.

14. The improvement of claim 13 wherein the gate is dimensioned to have a cross-sectional area of about 0.045 in.$^2$ to 0.125 in.$^2$.

15. The improvement of claim 13 wherein the gate is dimensioned so that the metal in the gate remains at a temperature above $T_f$ for a period of about 0.2 to about 5 seconds after application of pressure $P_2$.

16. The improvement of claim 13 wherein the feed gate is dimensioned so that at $P_1$ the gate velocity of the metal is about 40 to about 150 feet/sec.

17. The improvement of claim 13 wherein $P_2$ is about 10,000 to about 20,000 psi.

18. The improvement of claim 13 wherein the pressure is increased from $P_1$ to $P_2$ over a period of a fraction of a second before the cavity is filled.

19. The improvement of claim 13 further comprising the step of constructing said mold to have one or more intensification pins and forcing said intensification pins into said cavity after the temperature of the metal in the feed gate is less than or equal to $T_f$.

20. The process of claim 1 as applied to a heat treatable aluminum alloy and further comprising the step of subjecting the casting to T-6 heat treatment.

21. A process for die casting aluminum alloy metal in a die-casting apparatus of the type comprising at least a pair of dies forming at least one cavity therebetween having a small vacuum gate and a metal feed gate and a runner communicating with the metal feed gate for delivery of molten metal into the cavity, a source of molten metal, a charge sleeve communicating with said runner for receiving molten metal from said source and directing it through the runner to said feed gate into said cavity, said feed gate controlling the flow of metal from said runner into said cavity, a plunger reciprocally disposed in said sleeve and means for applying pressure to said plunger to force the molten metal under pressure through said runner and metal feed gate into said cavity, a vacuum source and means for connecting said source to said vacuum gate, cavity, runner and sleeve to remove gases therefrom and with sufficient suction quickly to draw the molten metal from its source through a transfer tube into said sleeve in a position to be driven by said plunger, the process comprising the steps of drawing the vacuum and quickly ladling the molten metal into said sleeve in a short amount of time to prevent any appreciable solidifying of the molten metal, immediately driving said plunger at high speed as soon as a full metal charge is ladled into said sleeve to drive molten metal through said metal feed gate into the cavity initially to fill said cavity, and thereafter immediately increasing the pressure on the molten metal to about 10,000 to about 20,000 psi to force additional molten metal through said feed gate as the metal solidifies and until the feed gate freezes closed, selecting the metal feed gate to have a cross-sectional area such that with the plunger actuation a high velocity feed from about 40 to about 150 feet/-second into said cavity during said initial cavity filling step, which allows metal flow through said feed gate during the pressure increasing step and which allows the metal in the gate to solidify after the pressure increasing step to seal the cavity containing molten metal under pressure, controlling the temperature of the molten metal in said source to a temperature less than about 100° F. above the temperature where the metal begins to solidify, permitting the metal to dwell in said cavity to solidify, and removing the casting from the cavity.

22. The process of claim 21 further comprising the step of heat treating the casting using a T-6 heat treating process.

23. The process of claim 22 comprising the step of quickly cool water quenching the casting after the T-6 heat.

* * * * *